US006626701B2

(12) United States Patent
Yoshida et al.

(10) Patent No.: US 6,626,701 B2
(45) Date of Patent: Sep. 30, 2003

(54) CONNECTOR

(75) Inventors: Haruki Yoshida, Shizuoka (JP); Motohisa Kashiyama, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/731,976

(22) Filed: Dec. 8, 2000

(65) Prior Publication Data

US 2001/0003686 A1 Jun. 14, 2001

(30) Foreign Application Priority Data

Dec. 8, 1999 (JP) ..... P. 11-348494

(51) Int. Cl.[7] ..... H01R 13/40
(52) U.S. Cl. ..... 439/595
(58) Field of Search ..... 439/595, 744, 439/871

(56) References Cited

U.S. PATENT DOCUMENTS

| | | | | | |
|---|---|---|---|---|---|
| 4,448,468 | A | | 5/1984 | Coldren | 339/74 R |
| 4,732,437 | A | * | 3/1988 | Vandame | 439/586 |
| 4,969,841 | A | * | 11/1990 | Sueyoshi et al. | 439/595 |
| 5,242,317 | A | | 9/1993 | Watanabe | 439/595 |
| 5,512,833 | A | | 4/1996 | Fukuda et al. | 324/538 |
| 5,613,878 | A | * | 3/1997 | Tsuji et al. | 439/595 |
| 5,645,452 | A | * | 7/1997 | Kodama | 439/595 |
| 5,716,232 | A | * | 2/1998 | Endo et al. | 439/595 |
| 5,752,859 | A | * | 5/1998 | Abe et al. | 439/595 |
| 5,938,482 | A | | 8/1999 | Yamatani | 439/752 |
| 6,244,900 | B1 | * | 6/2001 | Ishikawa et al. | 439/595 |

FOREIGN PATENT DOCUMENTS

| | | | |
|---|---|---|---|
| JP | 6-33373 | 4/1994 | H01R/13/115 |
| JP | 7-113836 | 5/1995 | G01R/31/04 |

OTHER PUBLICATIONS

European Search Report dated Mar. 12, 2001.

* cited by examiner

*Primary Examiner*—Renee Luebke
*Assistant Examiner*—Felix D. Figueroa
(74) *Attorney, Agent, or Firm*—Sughrue Mion, PLLC

(57) ABSTRACT

A connector (1) includes terminals (3), and a connector housing (2) having terminal receiving chambers (4). The terminal (3) has resilient curl portions (32, 32) of a generally mountain-like cross-sectional shape which are integrally formed respectively on opposite side edges of a base plate portion (31). A lance (5) is formed within the terminal receiving chamber (4), and two projections (23, 23) are formed integrally on the lance (5), and project in a direction of a width of the terminal receiving chamber (4) which direction is perpendicular to a direction (see P, in FIG. 7) of insertion of the terminal (3), and the two projections can be brought into sliding contact with apexes (41, 41) of the resilient curl portions (32, 32), respectively.

8 Claims, 8 Drawing Sheets

CONNECTOR

BACKGROUND OF THE INVENTION

1. Field of the Invention

The present invention relates to a connector, comprising terminals, each having resilient curl portions of a generally mountain-like cross-sectional shape integrally formed respectively on opposite side edges of a base plate portion, and a connector housing having lances for engagement with the resilient curl portions. More particularly, the present invention relates to an improved connector in which the amount of displacement of the lance in an engaged condition is stabilized.

The present application is based on Japanese Patent Application No. Hei. 11-348494, which is incorporated herein by reference.

2. Description of the Related Art

A connector, used for connecting vehicle's wire harnesses or the like together, comprises electrically-conductive female terminals of a known construction, and a connector housing of a synthetic resin for receiving the terminals.

The terminal is comprised of an electrically-conductive metal sheet, and resilient curl portions of a generally mountain-like cross-sectional shape for electrical contact purposes integrally formed respectively on opposite side edges of a base plate (see a terminal (low insertion force terminal) disclosed in Unexamined Japanese Utility Model Publication No. Hei. 6-33373).

Terminal receiving chambers for respectively receiving the terminals are formed in the connector housing. The terminal receiving chambers extend through the connector housing from a front end surface thereof to a rear end surface thereof, and terminal insertion ports are formed in the rear end surface of the connector housing, and connection ports for respectively receiving mating male terminals are formed in the front end surface of the connector housing.

A lance for retaining the terminal, received in the terminal receiving chamber, and an elastic displacement-allowing space for the lance are formed within each terminal receiving chamber. The lance has a tongue-like distal end portion. A retaining projection, projecting toward the terminal, is formed on the lance, and is disposed adjacent the distal end portion of the lance.

The retaining projection can engage the resilient curl portions of the terminal to prevent the terminal from moving in a withdrawing direction. The elastic displacement-allowing space is formed in that wall of the terminal receiving chamber on which the lance is formed. A lance displacement detection pin of a connector inspecting instrument can be inserted into the elastic displacement-allowing space through the insertion port, formed in the front end surface, to reach a position near to the proximal end portion of the lance.

The connector inspecting instrument includes the lance displacement detection pins and electrical contact pins. When the electrical contact pin is electrically connected to the corresponding terminal, it is judged that the terminal has been completely received in the terminal receiving chamber.

When the terminal is held in a half-inserted condition in the terminal receiving chamber, the lance is kept stranded on the terminal, with the retaining projection held in contact with inner slanting surfaces of the resilient curl portions, so that the distal end portion of the lance is sufficiently received in the elastic deformation-allowing space. In this condition, when the lance displacement detection pin is inserted into the elastic displacement-allowing space, this pin abuts against the distal end portion of the lance, so that the electrical contact pin can not contact the terminal, thereby detecting the half-inserted condition of the terminal.

In the above related connector, the resilient curl portions of the terminal in the connector have a generally mountain-like cross-sectional shape, and therefore the amount of displacement of the lance in an engaged condition is liable to be varied because of the adjustment of a terminal inserting force (required for inserting the terminal into the connector housing) and a load of contact of the terminal with the mating male terminal (not shown) (In the adjustment, the inclination of the inner slanting surfaces of the resilient curl portions is changed, and therefore the amount of displacement of the lance is influenced). As a result, the inspecting process, effected by the use of the connector inspecting instrument, is affected.

More specifically, if the amount of displacement of the lance in an engaged condition is small, the distal end portion of the lance may not be disposed in the elastic displacement-allowing space even when the terminal is in a half-inserted condition, and therefore there is a possibility that in the subsequent inspecting process, the lance displacement detection pin is completely inserted deep into the position near to the proximal end portion of the lance. When the lance displacement detection pin is thus completely inserted deep, the electrical contact pin abuts against the terminal to be electrically connected thereto, and therefore it is judged through the connector inspecting instrument that the terminal has been completely received in the terminal receiving chamber.

SUMMARY OF THE INVENTION

With the above problem in view, it is an object of the present invention to provide a connector in which the amount of displacement of a lance is stabilized so that the detection by a connector inspecting instrument can be effected positively.

To achieve the above object, according to the first aspect of the present invention, there is provided a connector which comprises a connector housing including a terminal receiving chamber, a metal terminal insertable into the terminal receiving chamber, the terminal including a base plate portion, a wire connecting portion formed on the base plate portion, and an electrical contact portion having resilient curl portions which extend from opposite side edges of the base plate portion and are inwardly bent to form curls thereof, a lance formed in the terminal receiving chamber, the lance having a distal end portion which extends in an inserting direction of the terminal, a retaining projection portion formed on the lance, the retaining projection portion retaining the terminal in a complete insertion state thereof to be prevented from moving in a withdrawing direction opposite to the inserting direction, and at least two projections integrally formed on the lance, the projections projecting in a width direction of the terminal receiving chamber which is perpendicular to the inserting direction of the terminal, wherein when the terminal is inserted into the terminal receiving chamber, the projections are respectively brought into sliding contact with apexes of the resilient curl portions.

In the present invention, when the terminal is inserted into the terminal receiving chamber, the lance, formed within the terminal receiving chamber, is elastically deformed by the terminal. The lance is continued to be elastically deformed by the terminal until the at least two projections, formed on the lance, slide onto the apexes of the resilient curl portions, respectively. When the terminal is thus inserted, the at least two projections are brought into sliding contact with the apexes of the resilient curl portions. When the terminal is completely inserted, the projections are disengaged from the apexes of the resilient curl portions, respectively, and the lance is restored into its original condition because of its own restoring force, and retainingly engages the terminal. The lance prevents the terminal from being withdrawn from the terminal receiving chamber.

If the terminal inserting operation is finished, with the terminal held in a half-inserted condition, the lance is kept stranded on the apexes of the resilient curl portions through the at least two projections, so that the amount of displacement of the lance is large. In a subsequent inspecting process, the half-inserted condition can be positively detected on the basis of the position of the distal end portion of the lance.

Even if the inclination of inner slanting surfaces of the resilient curl portions is changed when adjusting a terminal inserting force and a contact load, the height of the terminal from the base plate portion to the apexes of the resilient curl portions is not changed, and therefore the amount of displacement of the lance is stable. And besides, the amount of displacement of the lance in an engaged condition is large.

Preferably, the lance may be formed in a cantilever manner with respect to the connector housing to be elastically deformable. With respect to the resilient curl portions, it may be considered to have a generally mountain-like shape in a cross section thereof, and to be formed integrally with the opposite side edges of the base plate portion of the terminal. With respect to the retaining projection portion, it may be formed on a portion of the lance near to the distal end portion thereof, so that the retaining projection portion can engage the terminal to be retained in the terminal receiving chamber.

According to the second aspect of the present invention, each of the projections has a surface disposed in a plane in which a retaining surface of the retaining projection portion lies. In this case, when the lance is engaged with the terminal, the terminal is retained by the retaining projection portion and the at least two projections.

According to the third aspect of the present invention, each of the projections has a tapering surface so formed that each of the projections is decreased in thickness progressively in the withdrawing direction of the terminal opposite to the inserting direction. In this case, when the terminal is inserted into the terminal receiving chamber, the resilient curl portions of the terminal abut against the tapering surfaces, so that the terminal inserting force acts on these tapering surfaces. As the terminal is inserted, the tapering surfaces are pressed by the terminal, and therefore the lance can be easily elastically deformed. The projections will not be caught by the resilient curl portions, and therefore will not interfere with the insertion of the terminal.

DETAILED DESCRIPTION OF THE PREFERRED EMBODIMENT

Figure 1:
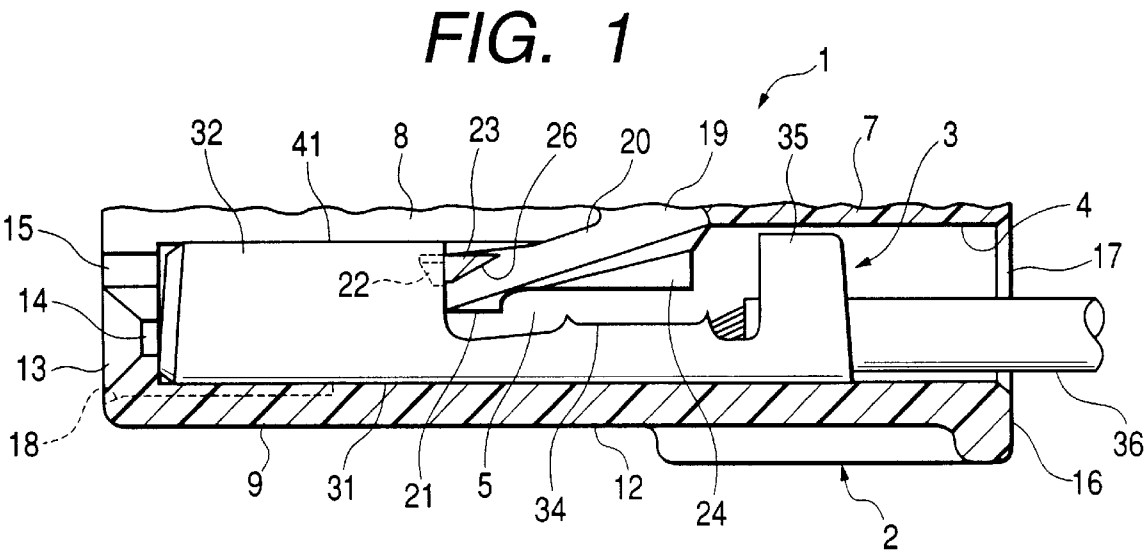
FIG. 1 is a cross-sectional view of one preferred embodiment of a connector of the present invention.

In FIG. 1, a connector 1, used for connecting vehicle's wire harnesses or the like together, comprises a connector housing 2 made of a synthetic resin, and a plurality of terminals 3 (only one of which is shown) received in the connector housing 2. The connector 1 is of such a construction that the amount of displacement of the lance 5, formed within a terminal receiving chamber 4 (formed in the connector housing 2) for receiving the terminal 3, is increased and stabilized, so that the detection of a half-inserted condition by a connector inspecting instrument 51 (described later; see FIG. 11) can be effected positively.

The above elements will now be described in detail.

The connector housing 2 is formed into a rectangular box-shape, and has the plurality of (for example, corresponding in number to the terminals 3) terminal receiving chambers 4 (only one of which is shown), each of the terminal receiving chamber 4 extending through the connector housing 2 from a front side thereof to a rear side thereof.

The terminal receiving chamber 4 defines a space of a rectangular parallelepiped shape for receiving the terminal 3 (see FIG. 1), and the lance 5 for retaining the completely-received terminal 3 (see FIG. 1) is formed integrally on an upper wall 7 of the terminal receiving chamber 4. An elastic displacement-allowing space 8 for the lance 5 is formed in the upper wall 7. The elastic displacement-allowing space 8 is provided for allowing the elastic deformation of the lance 5.

A lower wall 9 of the terminal receiving chamber 4, disposed in opposed relation to the upper wall 7, is formed into a flat surface, and a base end portion 31 (described later; see FIG. 6) of the terminal 3 can be disposed in sliding contact with this lower wall 9. A left wall 10 and a right wall 11, disposed perpendicularly to the upper and lower walls 7 and 9, serve as partition walls for the adjoining terminal receiving chambers 4 (not shown). The upper wall 7 and the lower wall 9 serve as partition walls for vertically-adjacent (upper and lower) terminal receiving chambers 4 (not shown) or as an upper wall (not shown) and a lower wall 12 of the connector housing 2, respectively.

The terminal receiving chamber 4 communicates with a connection port 14 and a detection pin insertion port 15, formed in a front wall 13 of the connector housing 2, and also communicates with a terminal insertion port 17 open to a rear end surface 16 of the connector housing 2.

The connection port 14 has a rectangular shape so as to receive a mating male terminal (not shown). A contact pin insertion port 18 for receiving an electrical contact pin 53 (described later; see FIG. 11) is continuous with the connection port 14.

The contact pin insertion port 18 is formed in opposed relation to the detection pin insertion port 15, with the connection port 14 disposed between the two ports 15 and 18. The electrical contact pin 53 (described later; see FIG. 11) can be inserted into (and removed from) the terminal receiving chamber 4 through the contact pin insertion port 18.

The detection pin insertion port 15 is disposed closer to the upper wall 7 than the connection port 14 is, and a lance displacement detection pin 54 (described later; see FIG. 11) can be inserted into (and removed from) the terminal receiving chamber 4 through the detection pin insertion port 15. The detection pin insertion port 15 communicates with a central portion of the connection port 14.

Figure 2:
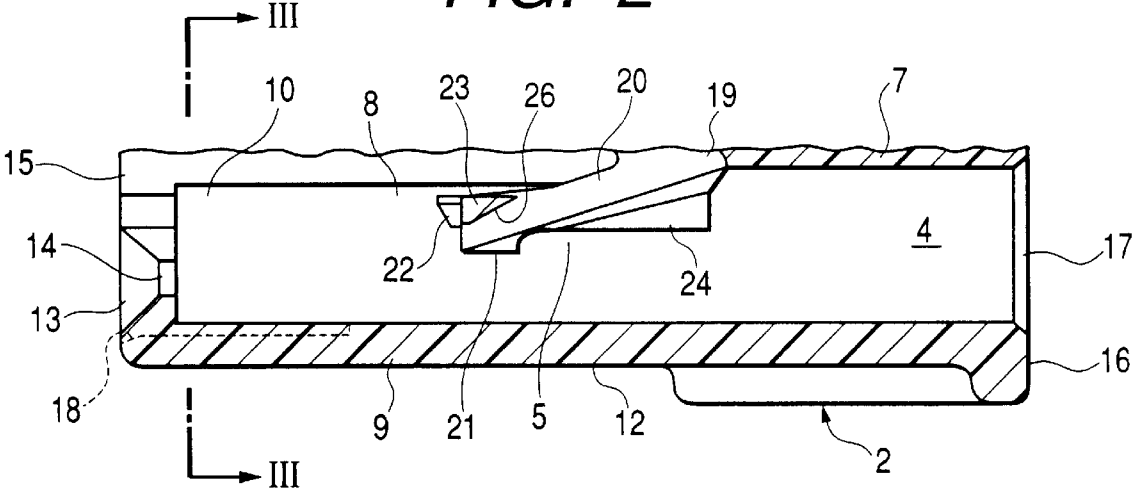
FIG. 2 is a cross-sectional view of a connector housing.

The upward-downward direction is the upward-downward direction in FIG. 2, and the forward-rearward direction is the left-right direction in FIG. 2. The right-left direction is the direction perpendicular to the sheet of FIG. 2, and corresponds to the width direction of the terminal receiving chamber.

Figure 3:
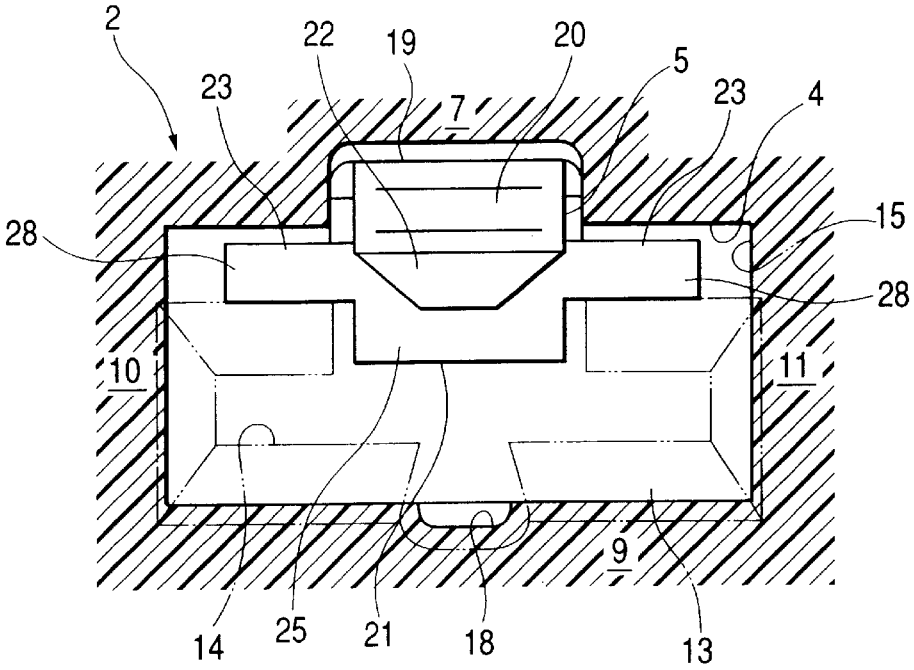
FIG. 3 is a cross-sectional view taken along the line III—III of FIG. 2.
Figure 4:
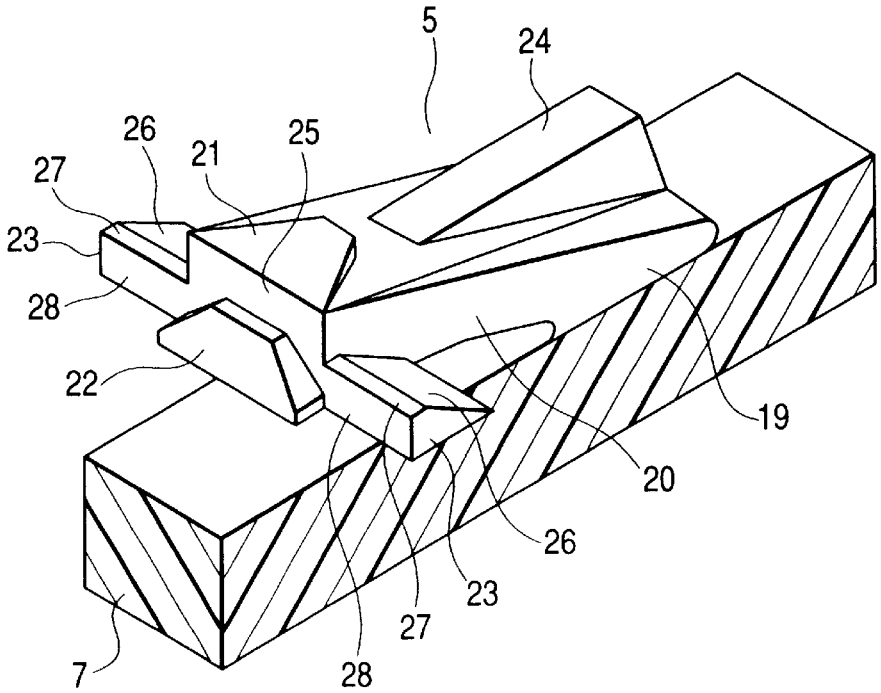
FIG. 4 is an enlarged perspective view of a lance.

As shown in FIGS. 2 to 4, the lance 5 is an arm-like retaining member extending from a generally central portion of the upper wall 7 (in the forward-rearward direction) in a direction P (see FIG. 7) of insertion of the terminal 3 (see FIG. 1). When the terminal 3 (see FIG. 1) is completely received in the terminal receiving chamber 4, the lance 5 prevents the terminal 3 (see FIG. 1) from moving in a withdrawing direction (not shown) opposite to the inserting direction P (see FIG. 7).

More specifically, the lance 5 includes a proximal end portion 19, an intermediate portion 20, a retaining projection portion 21, a distal end portion 22, and two projections 23 and 23. The distal end portion 22 of the lance 5 is bent (elastically deformed) toward the upper wall 7, and the retaining projection portion 21 and the two projections 23 and 23 can engage the terminal 3 (see FIG. 1).

The proximal end portion 19 is continuous with the generally-central portion of the upper wall 7 in the forward-rearward direction, and the intermediate portion 20 of the same width extends from a distal end of the proximal end portion 19. The intermediate portion 20 is in the form of a flattened bar or a plate-like piece. The intermediate portion 20 extends downwardly obliquely from the proximal end portion 19, and a rib 24, having a right-angled triangular shape (when viewed in the right-left direction) is formed integrally on a central portion of that surface of the intermediate portion 20 facing the lower wall 9.

A slanting side of the rib 24 is formed integrally on that surface of the intermediate portion 20, facing the lower wall 9, and the other two sides extend in the upward-downward direction and the forward-rearward direction, respectively.

The distal end portion 22 is formed on the distal end of the intermediate portion 20, and the retaining projection portion 21 and the two projections 23 and 23 are formed on the distal end portion of the intermediate portion 20. The distal end of the intermediate portion 20 is formed into a surface disposed in the upward-downward direction.

The retaining projection portion 21 is formed on that surface of the intermediate portion 20, facing the lower wall 9, at a corner portion of the distal end thereof. The retaining projection portion 21 has a retaining surface 25 formed at the distal end of the intermediate portion 20, and this retaining surface 25 can engage the terminal 3 (see FIG. 1).

The retaining projection portion 21 has a right-angled triangular shape when viewed in the right-left direction (The directions of three sides of this portion 21 are the same as the directions of the three sides of the rib 24, respectively). This retaining projection portion 21 has a trapezoidal shape (its upper side is close to the central portion of the intermediate portion 20, and its lower side coincides with the width of the intermediate portion 20) when viewed from that side where the lower wall 9 is disposed.

The distal end portion 22 is formed on and projects from that portion of the distal end of the intermediate portion 20 disposed close to the upper wall 7. The distal end portion 22 is formed into a trapezoidal shape narrowing progressively toward the lower wall 9. Slanting sides of this trapezoidal shape (that is, slanting surfaces of the distal end portion 22) generally conform in inclination to inner slanting surfaces 40 and 40 (see FIG. 5) of resilient curl portions 32 and 32 (described later).

When the lance 5 is elastically deformed, the distal end portion 22 can be positively disposed in the elastic deformation-allowing space 8.

The projections 23 and 23 are formed respectively on the opposite side surfaces of the intermediate portion 20 facing the left wall 10 and the right wall 11, respectively. The projections 23 and 23 project in the direction of the width of the terminal receiving chamber 4. Each of the projections 23 and 23 is decreasing in thickness progressively in the withdrawing direction (not shown) opposite to the inserting direction P (see FIG. 7) (that is, in the direction away from the front end of the connector housing 2 toward the rear end of the connector housing 2).

Each of the projections 23 and 23 includes a tapering surface 26, disposed parallel to that surface of the intermediate portion 20 facing the lower wall 9, a sliding surface 27, disposed parallel to the lower wall 9, and a retaining surface 28 disposed in a plane in which the retaining surface 25 lies.

The tapering surfaces 26 and 26, the sliding surfaces 27 and 27 and the retaining surfaces 28 and 28 are flat. The resilient curl portions 32 and 32 (described later; see FIG. 5) can abut against the tapering surfaces 26 and 26, respectively. Apexes 41 and 41 (see FIG. 5) of the resilient curl portions 32 and 32 (described later; see FIG. 5) can be brought into sliding contact with the sliding surfaces 27 and 27, respectively. Rear ends 47 and 47 (see FIG. 5) of the resilient curl portions 32 and 32 (described later; see FIG. 5) can engage the retaining portions 28 and 28, respectively (The retaining force is enhanced).

Figure 5:
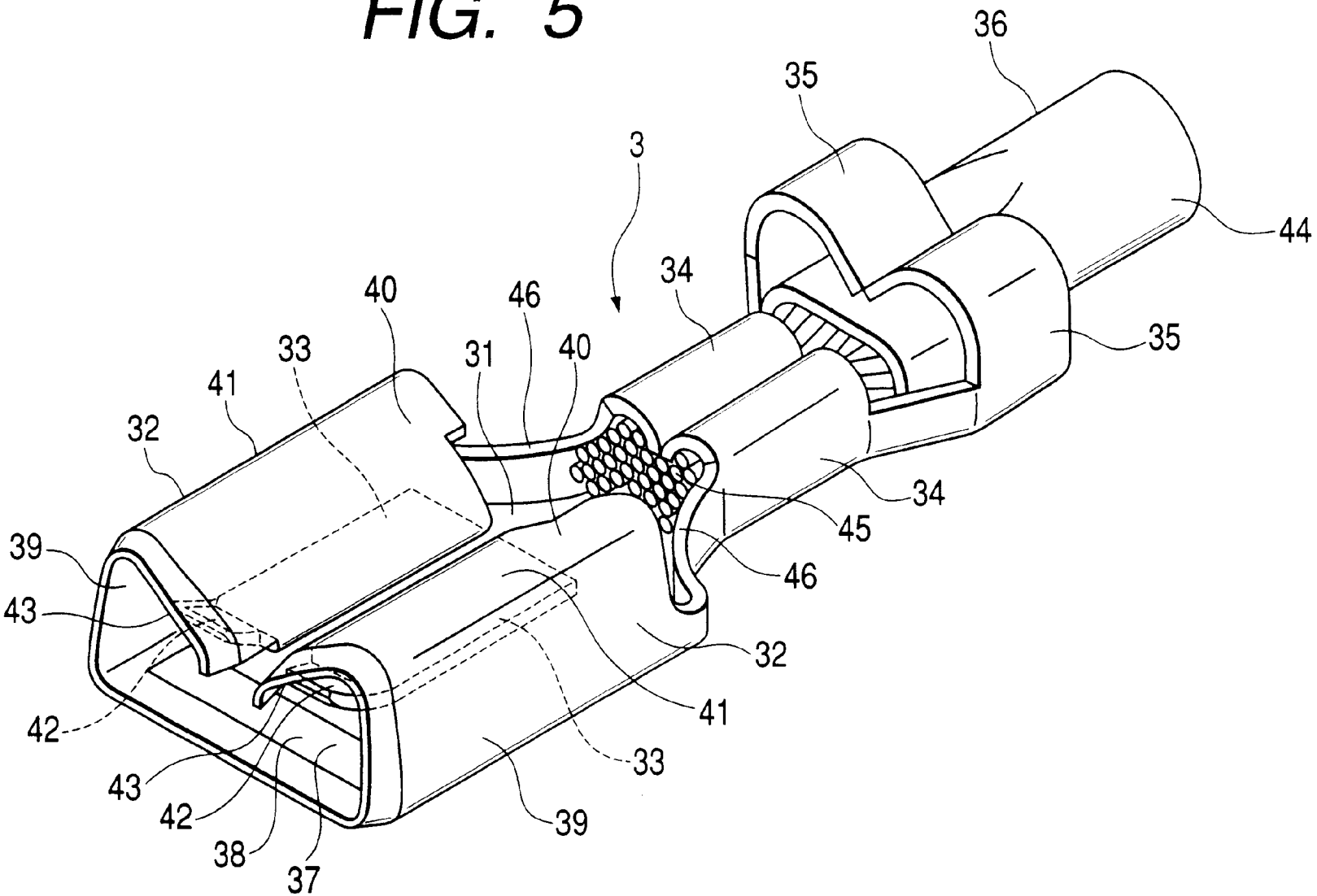
FIG. 5 is a perspective view of a terminal as seen obliquely from the upper side.
Figure 6:
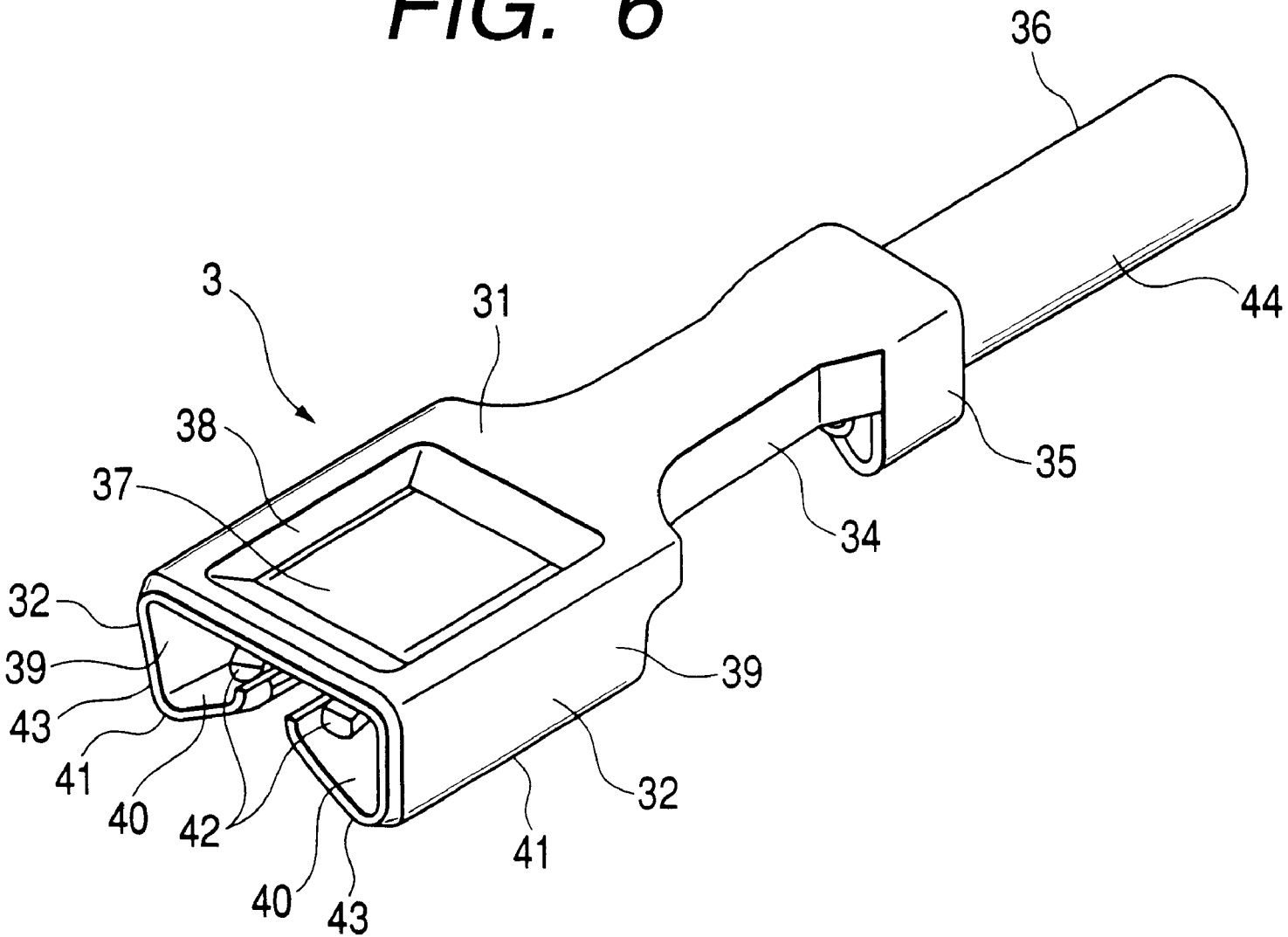
FIG. 6 is a perspective view of the terminal as seen obliquely from the lower side.

As shown in FIGS. 5 and 6, the terminal 3 is of the female type, and is formed by pressing an electrically-conductive metal sheet a plurality of times. The terminal 3 includes the spatula-like base plate portion 31, the pair of resilient curl portions 32 and 32, a pair of electrical contact piece portions 33 and 33, a pair of conductor clamping portions 34 and 34 and a pair of sheath clamping portions 35 and 35. The portions 32 and the portions 33 are formed at a front portion of the base plate portion 31 whereas the portions 34 and the portions 35 are formed at a rear portion of the base plate portion 31.

The front portion of this terminal serves as an electrical contact portion for the mating male terminal (not shown), and the rear portion thereof serves as a wire connection portion for a wire 36, for example, of a vehicle's wire harness.

An electrical contact convex portion 37 is formed on the front portion of the base plate portion 31 by embossing, and bulges toward the resilient curl portions 32 and 32. The electrical contact convex portion 37 cooperates with the electrical contact piece portions 33 and 33 to hold the mating male terminal (not shown) therebetween. The electrical contact convex portion 37 has a tapering surface 38 formed over an entire periphery thereof, and a front portion of the tapering surface 38 can guide the mating male terminal (not shown) into a predetermined position.

The resilient curl portions 32 and 32 are integrally formed respectively on opposite side edges of the front portion of the base plate portion 31, and each curl portion 32 has a piece-like shape having a large width in a direction of extending of the base plate portion 31. This piece-like portion, forming the curl portion 32, is inwardly bent into a generally mountain-like cross-sectional shape. An outer slanting surface 39 of each resilient curl portion 32 is defined by an abruptly-slanting surface (because of the generally mountain-like cross-sectional shape) disposed almost perpendicularly to the base plate portion 32. On the other hand, the inner slanting surface 40 of each curl portion is defined by a gently-slanting surface much more smaller in inclination than the outer slanting surface 39.

The projections 23 and 23 (see FIG. 4) of the lance 5 (see FIG. 5) can be brought into sliding contact with the apexes 41 and 41 of the resilient curl portions 32 and 32, respectively. When adjusting a terminal inserting force and a contact load, the inclination of the inner slanting surfaces 40 and 40 of the resilient curl portions 32 and 32 is changed, but the height of each resilient curl portion 32 from the base plate portion 31 to the apex 41 thereof is not changed.

Figure 10:
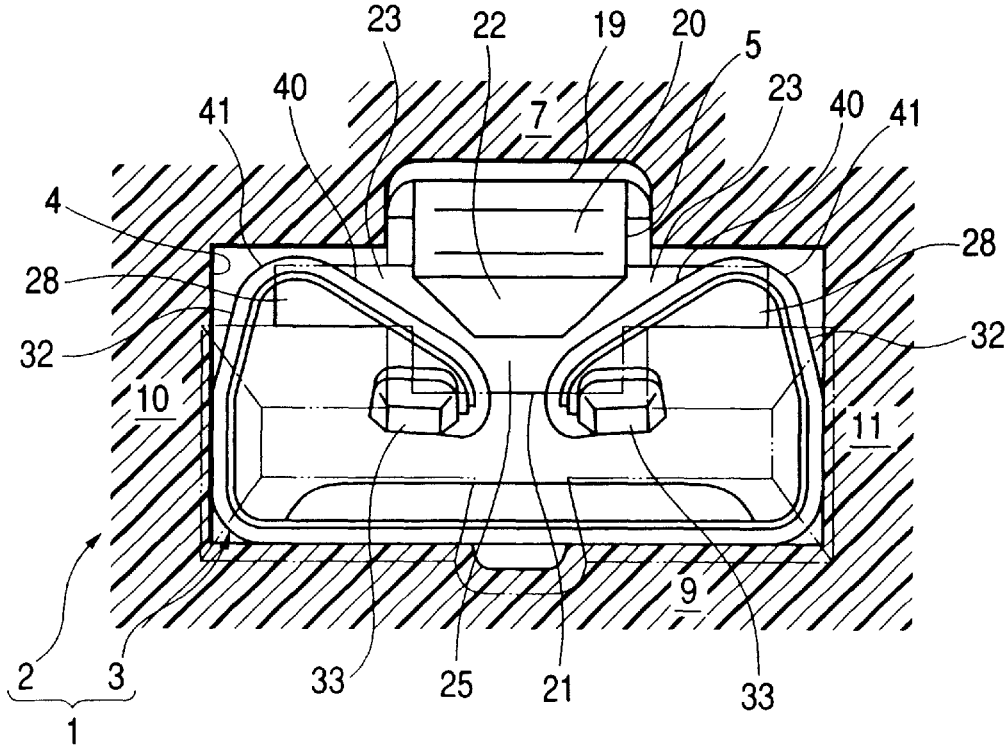
FIG. 10 is a cross-sectional view of the connector of FIG. 1 as seen from the front side of the terminal.

Each of the electrical contact piece portions 33 and 33 has a strip-like shape, and extends in the direction of extending of the base plate portion 31. The distal end portion of each resilient curl portion 32 is bent obliquely upwardly at a small angle to form the electrical contact piece portion 33. Front ends 42 and 42 of the electrical contact piece portions 33 and 33 are curved upwardly so as to guide the mating male terminal (not shown) into the predetermined position. The front ends 42 and 42 of the electrical contact piece portions 33 and 33 are disposed inwardly of front ends 43 and 43 of the resilient curl portions 32 and 32, respectively. retaining surfaces 28 and 28 of the projections 23 and 23 engage the rear ends 47 and 47, respectively (see FIG. 10).

As a result, the terminal 3 is completely received in the terminal receiving chamber 4. The lance 5 is thus engaged with the terminal 3, thereby preventing the terminal 3 from withdrawal from the terminal receiving chamber 4.

When all of the terminals 3 are received in the corresponding terminal receiving chambers 4, respectively, the assemblage of the connector 1 is completed.

The completed connector 1 is inspected by the connector inspecting instrument 51 so as to determine whether or not any of the terminals 3 is in a half-inserted condition.

Figure 11:
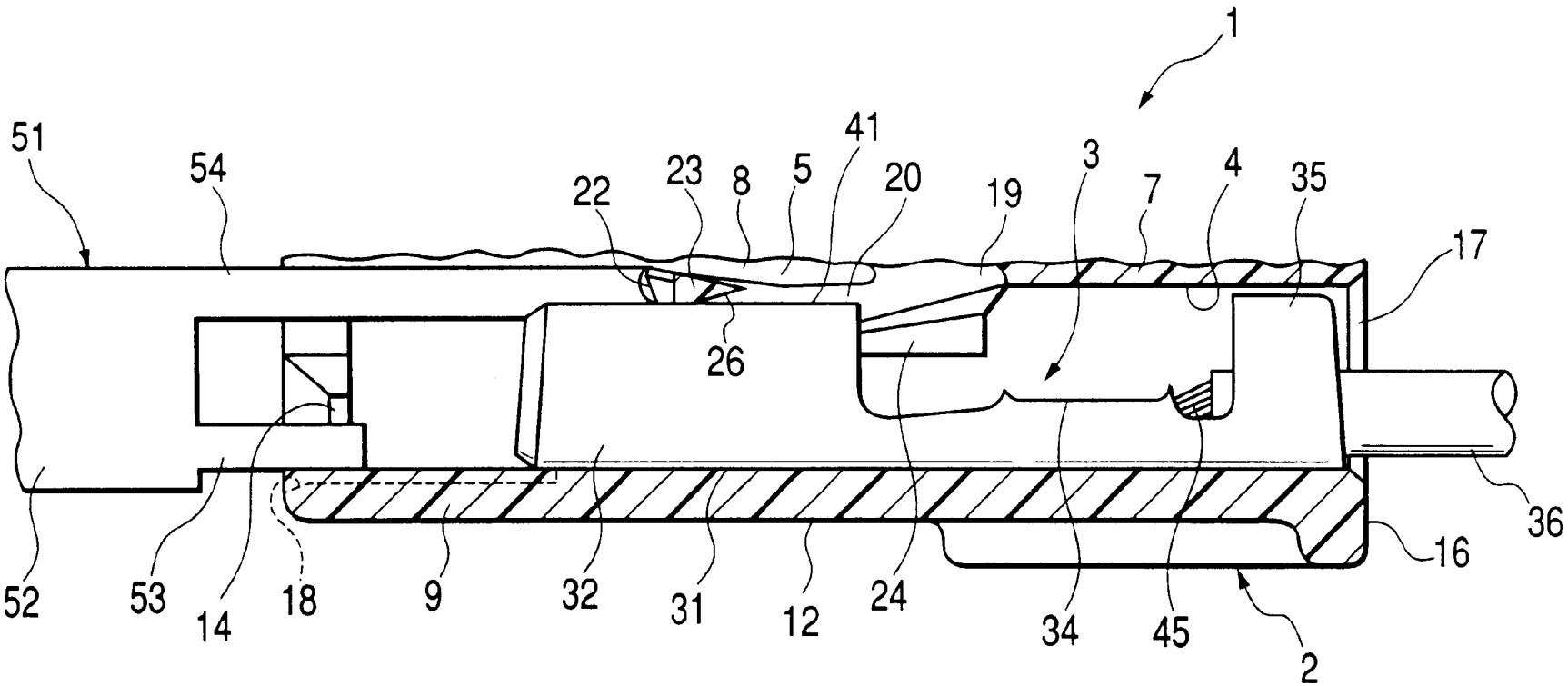
FIG. 11 is a cross-sectional view of the connector, showing the inspection by a connector inspecting instrument when the terminal is in a half-inserted condition.

In FIG. 11, the connector inspecting instrument 51 includes a plurality of inspection pin portions 52 (corresponding in number to the terminals 3 and also to the terminal receiving chambers 4). The inspection pin portion 52 has the electrical contact pin 53 and the lance displacement detection pin 54. The electrical contact pin 53, when inserted into the terminal receiving chamber 4, contacts the base plate portion 31 of the terminal 3, and the lance displacement detection pin 54 can abut against the The conductor clamping portions 34 and 34 of a rectangular shape are integrally formed respectively on opposite side edges of a front section of the rear portion of the base plate portion 31, and serve to hold a conductor 45 (exposed by removing a sheath 44) of the wire 36 at an end portion thereof. The conductor clamping portions 34 and 34 are compressively deformed to hold the conductor 45.

Frame portions 46 and 46 of a small height are integrally formed respectively on the opposite side edges of the base plate portion 31, and each frame portion 46 extends between the conductor clamping portion 34 and the resilient curl portion 32.

The sheath clamping portions 35 and 35 serve to hold the sheath 44 of the wire 36, and have a rectangular shape, and are larger in length than the conductor clamping portions 34 and 34. The sheath clamping portions 35 and 35 are integrally formed respectively on opposite side edges of a rear section of the base plate portion 31. The sheath clamping portions 35 and 35 are compressively deformed to hold the sheath 44, and the conductor 45, covered with the sheath 44, is compressed through the sheath 44.

In the above construction, for assembling the connector 1, the terminals 3 are inserted respectively into the terminal receiving chambers 4.

Figure 7:
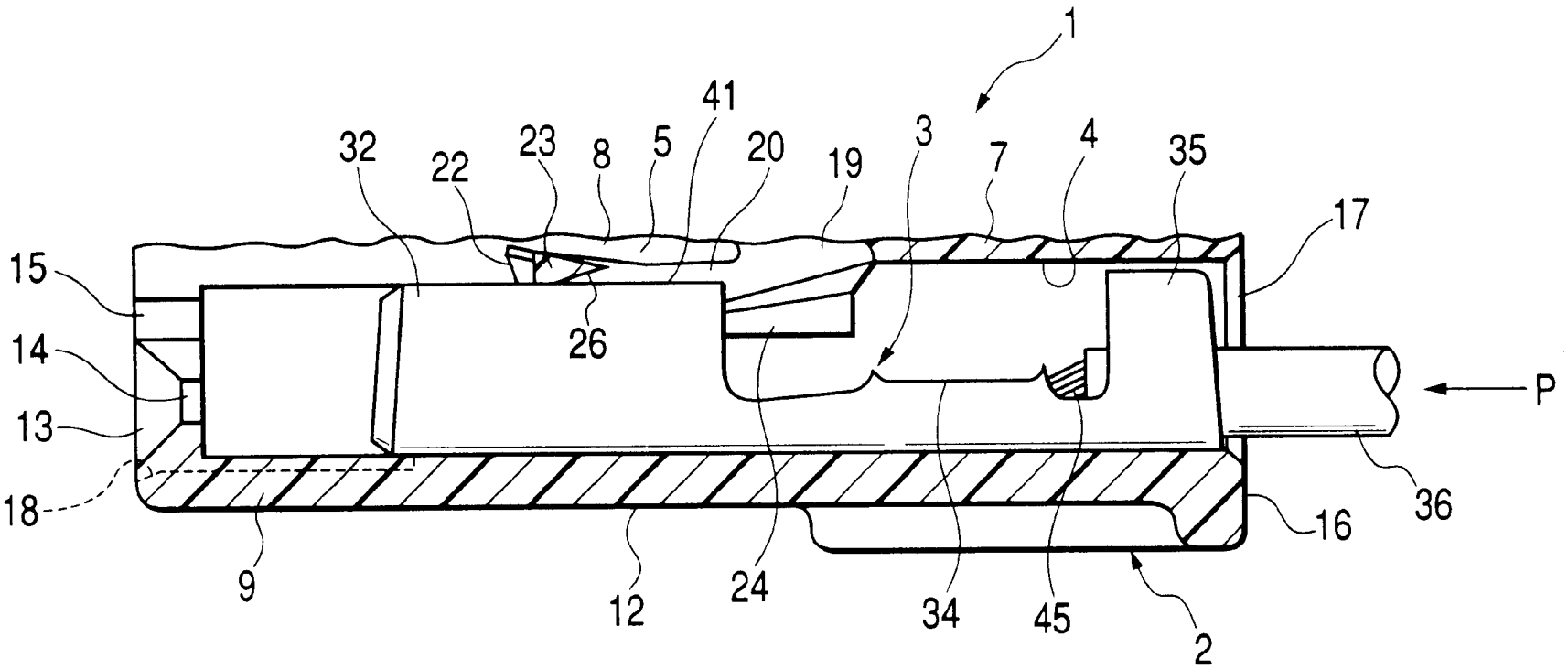
FIG. 7 is a cross-sectional view of the connector, showing a condition when the terminal is inserted.
Figure 8:
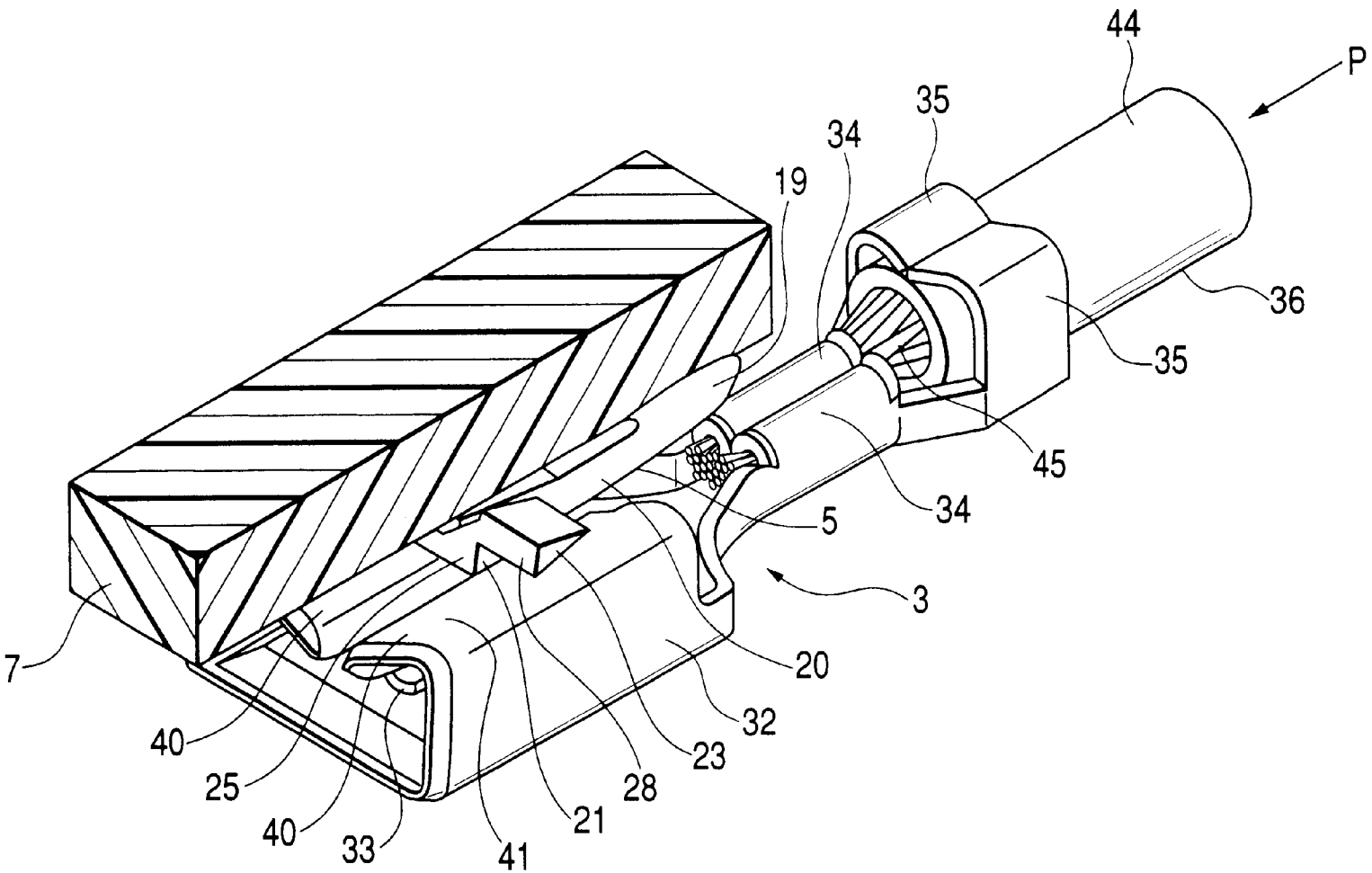
FIG. 8 is an enlarged, perspective view of an important portion, showing a condition when the terminal is inserted.
Figure 9:
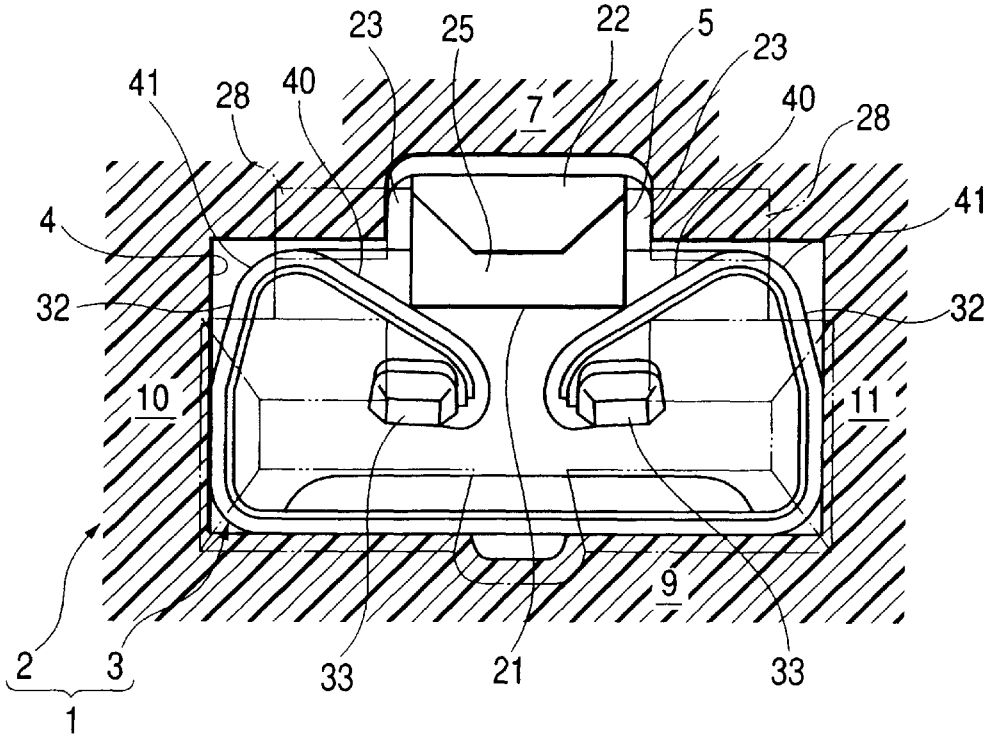
FIG. 9 is a cross-sectional view of the connector of FIGS. 7 and 8 as seen from the front side of the terminal.

When the terminal 3 is inserted into the terminal receiving chamber 4 as shown in FIGS. 7 to 9, the lance 5 within the terminal receiving chamber 4 is elastically deformed by the terminal 3. More specifically, the resilient curl portions 32 and 32 of the terminal 3 abut respectively against the tapering surfaces 26 and 26 of the projections 23 and 23 of the lance 5 to press the tapering surfaces 26 and 26, so that the lance 5 is elastically deformed in such a manner that the distal end portion 22 moves toward the upper wall 7. Then, the lance 5 is continued to be elastically deformed by the terminal 3 until the projections 23 and 23 slide onto the apexes 41 and 41 of the resilient curl portions 32 and 32, respectively.

In this condition, when the terminal 3 is further inserted, the projections 23 and 23 come into sliding contact with the apexes 41 and 41 of the resilient curl portions 32 and 32, respectively. When the apexes 41 and 41 of the resilient curl portions 32 and 32 move past the projections 23 and 23, respectively, the lance 5 is restored into its original condition because of its restoring force, and engages the rear ends 47 and 47 of the resilient curl portions 32 and 32. The lance 5 in a half-inserted condition of the terminal.

The electrical contact pin 53 is shorter than the lance displacement detection pin 54. The electrical contact pin 53 and the lance displacement detection pin 54 are electrically disconnected from each other.

In this embodiment, a half-inserted condition of the terminal 3 can be detected by the use of the connector inspecting instrument 51 of a known construction (disclosed, for example, in Unexamined Japanese Utility Model Publication No. Hei. 7-113836). Therefore, the showing of this connector inspecting instrument is simplified in the drawing.

In FIG. 11, when the operation for inserting the terminal 3 is finished, with the terminal 3 held in a half-inserted condition, the lance 5 is kept stranded on the apexes 41 and 41 of the resilient curl portions 32 and 32 through the projections 23 and 23. Therefore, when the lance displacement detection pin 54 is inserted into the terminal receiving chamber 4 along the upper wall 7, this lance displacement detection pin 54 is brought into abutting engagement with the lance 5, thus detecting the half-inserted condition. Namely, when the lance displacement detection pin 54 abuts against the lance 5, the electrical contact pin 54 can not contact the terminal 3, and therefore can not be electrically connected to the terminal 3, so that the half-fitted condition is detected.

On the other hand, when the terminal 3 is completely received in the terminal receiving chamber 4, the lance displacement detection pin 54 can be inserted deep (into a position near to the proximal end portion 19 of the lance 5).

Therefore, the electrical contact pin 54 can contact the terminal 3 to be electrically connected thereto, and therefore it is judged that the terminal 3 is completely received in the terminal receiving chamber 4.

As described above with reference to FIGS. 1 to 11, the lance 5 has the two projections 23 and 23 for sliding contact respectively with the apexes 41 and 41 of the resilient curl portions 32 and 32 of the terminal 3, and therefore, in a half-inserted condition of the terminal 3, the lance 5 is much displaced from its initial condition. And besides, the height of the terminal 3 from the base plate portion 31 to the apexes 41 and 41 of the resilient curl portions 32 and 32 is not changed, and therefore the amount of displacement of the lance 5 is always stable. Therefore, the detection by the connector inspecting instrument 51 can be positively effected.

Various modifications can be made without departing from the scope of the present invention.

Although not shown in the drawings, the connector can be of such a construction that the terminal receiving chambers 4 are arranged in two (upper and lower) rows, or are juxtaposed in a row.

As described above, in the present invention, the connector comprises the terminals, and the connector housing having the terminal receiving chambers, and the lance, formed within the terminal receiving chamber, has the two projections for sliding contact respectively with the apexes of the resilient curl portions of the terminal. Therefore, the amount of displacement of the lance can be increased and stabilized.

Namely, the lance is elastically deformed by the terminal until the two projections slide onto the apexes of the resilient curl portions, respectively, and therefore the amount of displacement of the lance in the engaged condition is large. Even if the inclination of the inner slanting surfaces of the resilient curl portions is changed when adjusting the terminal inserting force and the contact load, the height of the terminal from the base plate portion to the apexes of the resilient curl portions is not changed, and therefore the amount of displacement of the lance is always stable.

If the terminal inserting operation is finished, with the terminal held in a half-inserted condition, the lance is kept stranded on the apexes of the resilient curl portions through the two projections, so that the amount of displacement of the lance is large. In the subsequent inspecting process, the half-inserted condition can be positively detected on the basis of the position of the distal end portion of the lance.

Therefore, there is achieved an advantageous effect that there can be provided the connector in which the amount of displacement of the lance is stable, and the detection by the connector inspecting instruction can be positively effected.

In the present invention, each of the projections has the surface disposed in a plane in which the retaining surface of the retaining projection portion lies. Therefore, the terminal can be retained by the retaining projection portion and the two projections.

Therefore, in addition to the above effect, there is achieved an advantageous effect that the retaining force for retaining the terminal is enhanced. Therefore, the better connector can be provided.

In the present invention, each of the projections is decreasing in thickness progressively in the withdrawing direction opposite to the terminal inserting direction, thereby forming the tapering surface. Therefore, although the projections are formed on the lance, these projections will not affect the terminal inserting operation.

Therefore, the above advantageous effects of the present invention can be achieved, while maintaining the operation efficiency as achieved with the related construction.

What is claimed is:

1. A connector, comprising:

a connector housing including a terminal receiving chamber;

a metal terminal insertable into the terminal receiving chamber, the terminal including a base plate portion, a wire connecting portion formed on the base plate portion, and an electrical contact portion having resilient curl portions which extend from opposite side edges of the base plate portion and are inwardly bent to form curls having apexes defined thereon and having a recessed portion located between the apexes;

a lance formed in the terminal receiving chamber, the lance having a base portion that attaches to the connector housing and an end portion opposite to the base portion, the end portion extending in an inserting direction of the terminal;

a retaining projection portion formed on the lance, the retaining projection portion extending into the recessed portion of the metal terminal during a half-insertion state and retaining the terminal in a complete insertion state thereof to be prevented from moving in a withdrawing direction opposite to the inserting direction; and at least two projections integrally formed on the lance at opposite side surfaces of the end portion and having a different height than the retaining projection portion, the projections projecting from the end portion in a width direction of the terminal receiving chamber which is perpendicular to the inserting direction of the terminal, wherein a combined width of the projections, extending in the width direction from an end of one of the projections to an end of another one of the projections, is greater than the width of the base portion, wherein when the terminal is inserted into the terminal receiving chamber, only the projections are respectively brought into sliding contact with apexes of the resilient curl portions.

2. The connector of claim 1, wherein the lance is formed in a cantilever manner with respect to the connector housing to be elastically deformable.

3. The connector of claim 1, wherein each of the resilient curl portions has a generally mountain-like shape in a cross section thereof.

4. The connector of claim 1, wherein the retaining projection portion is formed on a portion of the lance near to the distal end portion thereof, the retaining projection portion engages the terminal to be retained in the terminal receiving chamber.

5. The connector of claim 1, wherein the curl portions are respectively formed integrally with the opposite side edges of the base plate portion of the terminal.

6. The connector of claim 1, wherein each of the projections has a surface disposed in a plane in which a retaining surface of the retaining projection portion lies.

7. The connector of claim 6, wherein each of the projections has a tapering surface so formed that each of the projections is decreased in thickness progressively in the withdrawing direction of the terminal opposite to the inserting direction.

8. The connector of claim 1, wherein each of the projections has a tapering surface so formed that each of the projections is decreased in thickness progressively in the withdrawing direction of the terminal opposite to the inserting direction.

* * * * *